United States Patent [19]

Bays

[11] Patent Number: 4,732,506

[45] Date of Patent: Mar. 22, 1988

[54] SURFACE CRUSHING APPARATUS

[75] Inventor: Marvin G. Bays, Ponca City, Okla.

[73] Assignee: Mertz, Inc., Ponca City, Okla.

[21] Appl. No.: 940,981

[22] Filed: Dec. 12, 1986

[51] Int. Cl.[4] ..... E01C 23/12

[52] U.S. Cl. ..... 404/90; 404/133; 299/37; 173/94

[58] Field of Search ..... 404/90, 91, 133; 299/26, 36, 37, 69; 173/94, 98, 99, 49

[56] References Cited

U.S. PATENT DOCUMENTS

| | | | |
|---|---|---|---|
| 1,250,521 | 12/1917 | Schumacher | 299/37 X |
| 1,841,802 | 1/1932 | Gettelman | 299/37 |
| 2,529,892 | 11/1950 | Adams | 299/37 X |
| 3,133,730 | 5/1964 | Cornett | 404/90 X |
| 4,250,760 | 2/1981 | Gurries | 299/37 X |
| 4,251,111 | 2/1981 | Gurries | 299/37 |
| 4,258,956 | 3/1981 | Gurries | 173/49 X |
| 4,340,255 | 7/1982 | Gurries | 299/37 |
| 4,402,629 | 9/1983 | Gurries | 404/90 |
| 4,457,645 | 7/1984 | Klochko | 404/90 |
| 4,511,282 | 4/1985 | Gurries | 404/90 |
| 4,515,408 | 5/1985 | Gurries | 404/90 X |

FOREIGN PATENT DOCUMENTS

| | | | |
|---|---|---|---|
| 846720 | 7/1981 | U.S.S.R. | 404/133 |

*Primary Examiner*—Stephen J. Novosad

*Assistant Examiner*—John F. Letchford

*Attorney, Agent, or Firm*—William J. Miller

[57] ABSTRACT

This invention describes an apparatus for breaking a hard surface such as a concrete road or bridge deck and essentially consists of a support for a torsional spring which is horizontally fixed to the support with a spaced rotational journal so that the torsional spring is mounted substantially horizontally. An oscillating member of desired mass characteristics is attached to the torsional spring with a force generating apparatus such as a hydraulic vibrator on one end of the oscillating member and a road crushing tool on the opposite end of the oscillating member. The oscillating member is attached rigidly to the torsional spring. Apparatus is also provided for positioning the impact or road crushing tool against the surface to be crushed and for maintaining the tool in that position during the crushing operation.

The hydraulic vibrator, when it is operated, causes an axial oscillation in the torsional spring/mass system. This axial oscillation is then transferred to an axial oscillation of the impact tool, causing the tool to violently impact the surface to be crushed. The apparatus is preferably operated at the resonant frequency of the spring-/mass system to obtain maximum amplitude and a corresponding increase in energy generated in the resonant mode. Other embodiments using the same principal are disclosed.

27 Claims, 15 Drawing Figures

SURFACE CRUSHING APPARATUS

BRIEF DESCRIPTION OF THE PRIOR ART

The best prior art known to Applicant is U.S. Pat. No. 4,402,629 issued Sept. 6, 1983, to Raymond A. Gurries, entitled "Resiliency Driven Pavement Crusher". This apparatus described a road breaker or Crusher using a resonating beam. One end of the resonating beam has a swinging weight vibrator attached thereto and the opposite end has a road crushing apparatus. The beam is supported at two nodal points and is operated at a preselected frequency which must be maintained at or extremely near the preselected frequency of the system so that the nodal points will not change location. The basic problem with the above arrangement is that it is virtually impossible to maintain the frequency at or near the proper frequency, thus, the nodal points will shift along the beam causing extreme damage or destruction of the beam or the pivots at the nodal points supporting the beam. As a result, the system reliability is poor, causing excessive down-time and maintenance costs.

BRIEF DESCRIPTION OF THE INVENTION

This invention basically utilizes a hydraulic vibrator which can be carefully controlled in its frequency of operation by external electronic control means. The hydraulic vibrator is supported in a holding fixture in a manner so that the hydraulic vibrator is basically isolated from the holding fixture. The vibrator then has means for coupling the forces generated by the vibrator to the impacting pool striking the pavement or other road surface in a manner to crush or crack the road surface so that it can be easily removed by other equipment.

Several embodiments are included which will function in a manner described above.

This invention features a closed-loop electro-hydraulic control system. The amplitude of the high frequency oscillations may be precisely controlled allowing the device to be safely utilized in close proximity to relatively fragile underground utility pipe lines and electrical cables. Such operation can not be done safely wih high amplitude, low frequency impact devices such as weight drops using gravity, steam or hydraulics to accelerate an impacting mass.

Further, the low amplitude high frequency operation of the impacting tool virtually eliminates the danger from flying debris, noise and broken fragments which are common to the high amplitude, low frequency breaking devices.

DETAILED DESCRIPTION OF THE FIGURES

Figure 1:
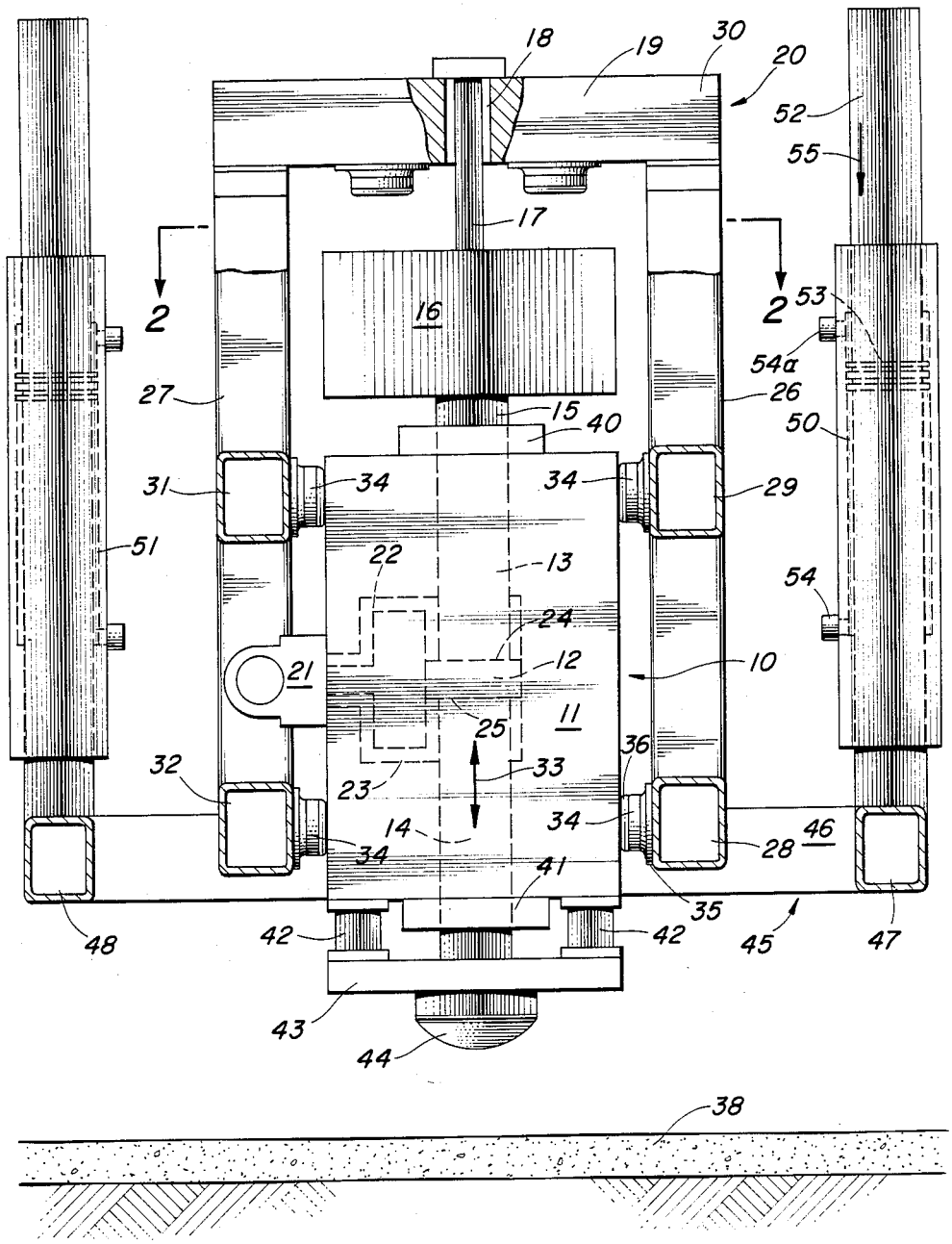
FIG. 1 is a side view of one embodiment of this invention taken through the lines 1—1 of FIG. 2.
Figure 3:
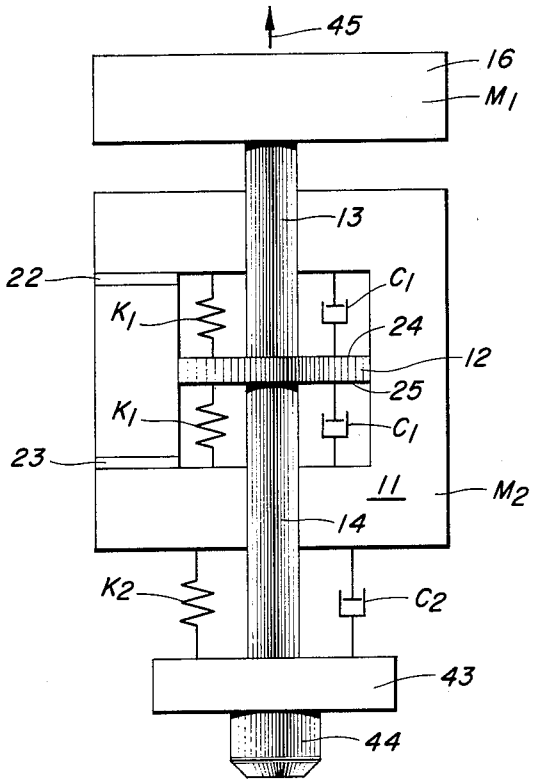
FIG. 3 is an illustrative drawing showing the operation of the apparatus of FIGS. 1 and 2.
Figure 2:
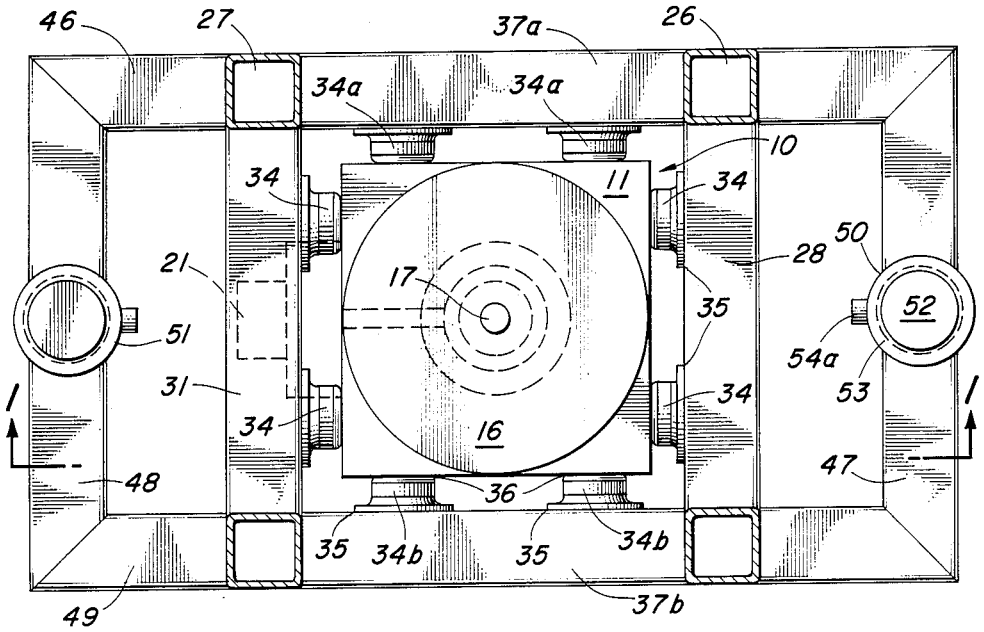
FIG. 2 is the top view of the apparatus illustrated in FIG. 1 taken through the lines 2—2 of FIG. 1.

Referring to all of the Figures but in particular to FIGS. 1 through 3, a hydraulic oscillating force generating means 10 is illustrated which essentially comprises a mass 11 having a hydraulic cylinder therein, a piston 12, an upper piston rod 13 and a lower piston rod 14. An extension 15 of upper piston rod 13 has attached thereto a second mass 16. A further extension 17 is attached to mass 16 and provides upper support for upper piston rod 13, through a bearing 18 which is mounted in an upper portion 19 of support means 20. A hydraulic control valve 21 has ports 22 and 23 communicating with the upper surface 24 and lower surface 25 of piston 12. The hydraulic input and outputs from the pump and to the sump have not been illustrated since they are well known in the art. Likewise, the electrical control system which operates control valve 21 has not been illustrated as it is well known in the art.

Support means 20 essentially consists of a plurality of structural tubing or members positioned vertically and horizontally to support mass 11, such structural members as 26 and 27 provide vertical support, while structural members 28, 29, 30, 31 and 32 provide horizontal support for mass 11.

Since mass 11 will be relatively stationary and second mass 16 will be moving in the direction of arrow 33, means must be provided to horizontally and vertically support mass 11. To accomplish the above, a plurality of pads 34 surround mass 11. Pads 34 are attached on one side 35 to structural members 28, for example, and the opposite side 36 is slidably pressed against mass 11.

Referring to FIG. 2, it can be seen that pads 34 have their base 35 attached by any usual means to structural member 28 and 31. Additional pads 24*a* and 34*b* are attached to horizontal channel members 37*a* and 37*b*, respectively.

Referring to FIG. 1, bearings and seals are provided as necessary between piston rods 13 and 14 and mass 11. End caps 40 and 41 may be provided to remove piston rods 13, 14, piston 12 and seals (not shown). Mass isolators 42 are attached between mass 11 and plate 43. Impacting tool 44 is attached in the usual manner to plate 43, such as, for example, bolts which are not illustrated in the drawing.

Vertical support system or means 20 normally has two positions. A lifted position for the purpose of transportation and a lowered position for the purpose of impacting and cracking a surface such as a roadway 38. Furthermore, vertical support system or means 20 will need to be varied from time to time with its respect to roadway 38 due to the conditions of roadway 38 and breakage of roadway 38. Lift system 20 referred to by arrow 45 generally comprises a structural member 46 and members which are at right angles to structural member 46 such as tubing members 47 and 48. An additional structural member 49 is illustrated in FIG. 2, completes the lower rectangular support system. Movement of the lift system is accomplished by hydraulic cylinders 50 and 51 which are attached to a vehicle, not illustrated in this drawing. A piston rod 52 is attached in its upper portion to the vehicle and in the lower position to structural member 47. A piston 53 is positioned inside cylinder 50 with hydraulic connections 54 and 54a attached thereto for lifting or lowering piston 53 upon proper actuation of the hydraulic system. Cylinder 51 and its arrangement is identical to that of cylinder 50 and will not be described in detail.

OPERATION OF THE EMBODIMENT ILLUSTRATED IN FIGS. 1-3

The apparatus illustrated in FIG. 1 is in the first or transportation position, that is impact tool 44 is a sufficient distance above roadway 38 so that it will not strike roadway 38 during normal transportation. When a portion of roadway 38 is to be impacted and crushed or fractured, hydraulic fluid is applied to pipe **54*a* and released from pipe 54 which fluid will travel to the sump (not shown). Release of hydraulic fluid will then cause piston 52 to move in the direction of arrow 55 causing impact tool 44 to lower onto or close to the surface of roadway 38. Once impact tool 44 is in the desired position, then hydraulic pressure is applied to hydraulic control valve 21 which will pass hydraulic fluid through ports 22 and 23 to upper surface 24 and lower surface 25 of piston 12. Hydraulic control valve 21 will then be operated electrically to oscillate the fluid alternately into port 22 and out of port 23 and vice versa causing piston 12 and rods 13 and 14 and second mass 16 to oscillate in the direction of arrow 33. With the proper selection of mass 16, weight of piston rods 11 and 13, piston 12** and hydraulic fluid and other obvious factors, the system can be placed into resonance which will provide the greatest force output for the hydraulic system.

Referring to FIG. 3, mass M1 represents the weight or second mass 16, weight of piston rods 13 and 14, piston 12, plate 43 and impact tool 44. Mass M2 represents reaction mass 11. If the frequency is 45 Hertz, for example, and $M1=2{,}700/386$ pound-second$^2$/inch; $K1=5.40\times10^5$ pounds per inch at resonance; $C1=0.05$ which represents the damping factor; $M2=13{,}500/386$ pound-second$^2$/inch with $K2=16{,}000$ pounds per inch as a spring constant; and C2 proportional to 0.09; then a potential energy output of 70,000 inches per pounds can be expected. Such energy is quite capable of fracturing roads or bridge surfaces. As described, with hydraulic fluid entering ports 22 or 23 pressure will be placed alternatively on upper surface 24 or lower surface 25 of piston 12. Such a force will oscillate piston 12 with respect to reaction mass 11. Since reaction mass 11 is substantially larger in mass than mass 16, piston rod 13, piston 12, piston rod 14, plate 43 and impact tool 44, the assembly just mentioned will move upwardly and downwardly at an oscillating rate dependent upon the frequency of the cycling of hydraulic fluid into and out of ports 22 and 23. With the design as mentioned, the system can function at resonance, thus generating a substantial force in impact tool 44. Vibration isolators 42 provide support for plate 43 and tool 44, preventing tool 44 from rotating and likewise isolating the oscillations of tool 44 and plate 43 from being coupled to reaction mass 11.

Figure 6:
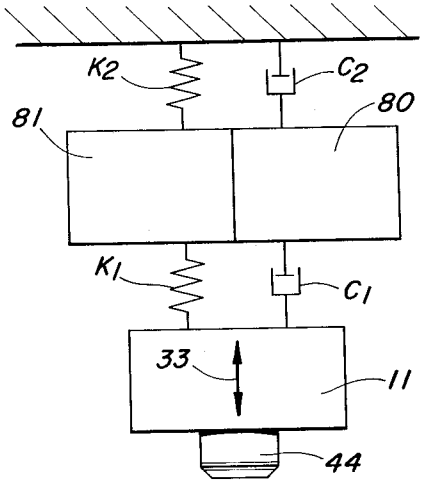
FIG. 6 is a diagram illustrating the operation of the mass force system illustrated in FIGS. 4 and 5.
Figure 4:
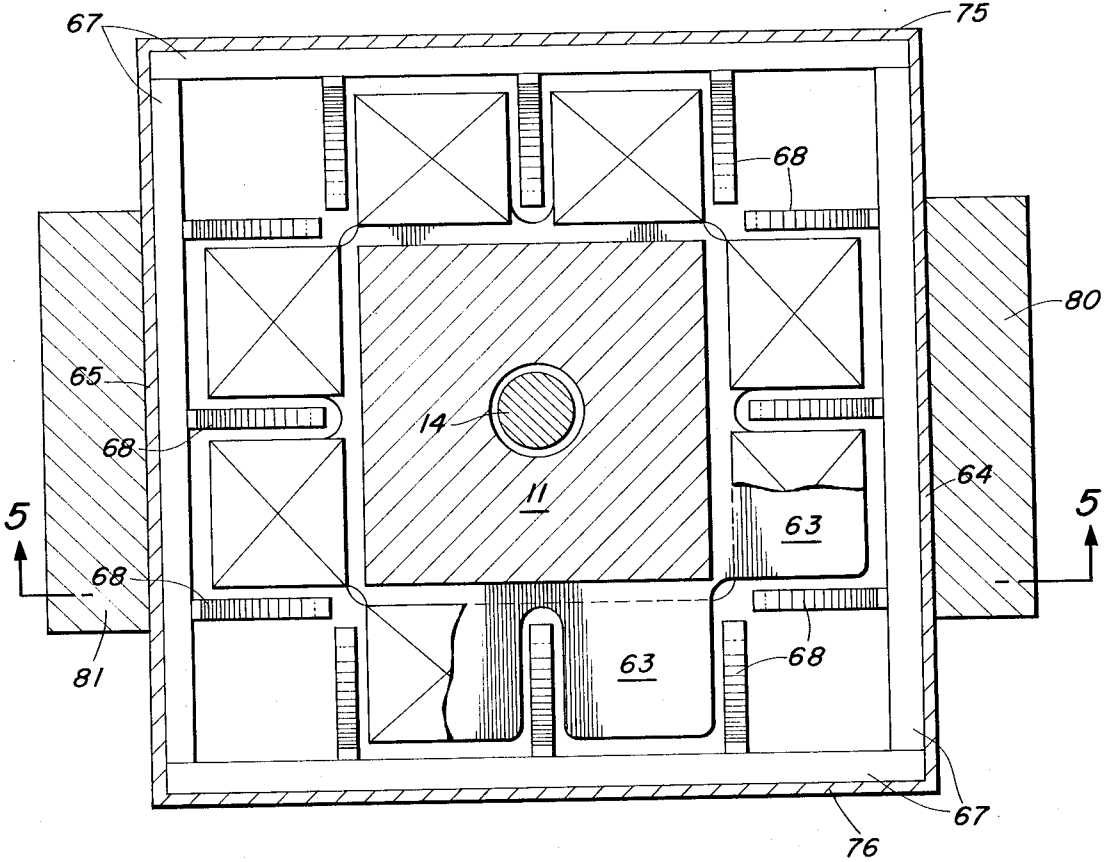
FIG. 4 is a modified embodiment of the apparatus illustrated in FIGS. 1 through 3, taken through the 4—4 of FIG. 5.
Figure 5:
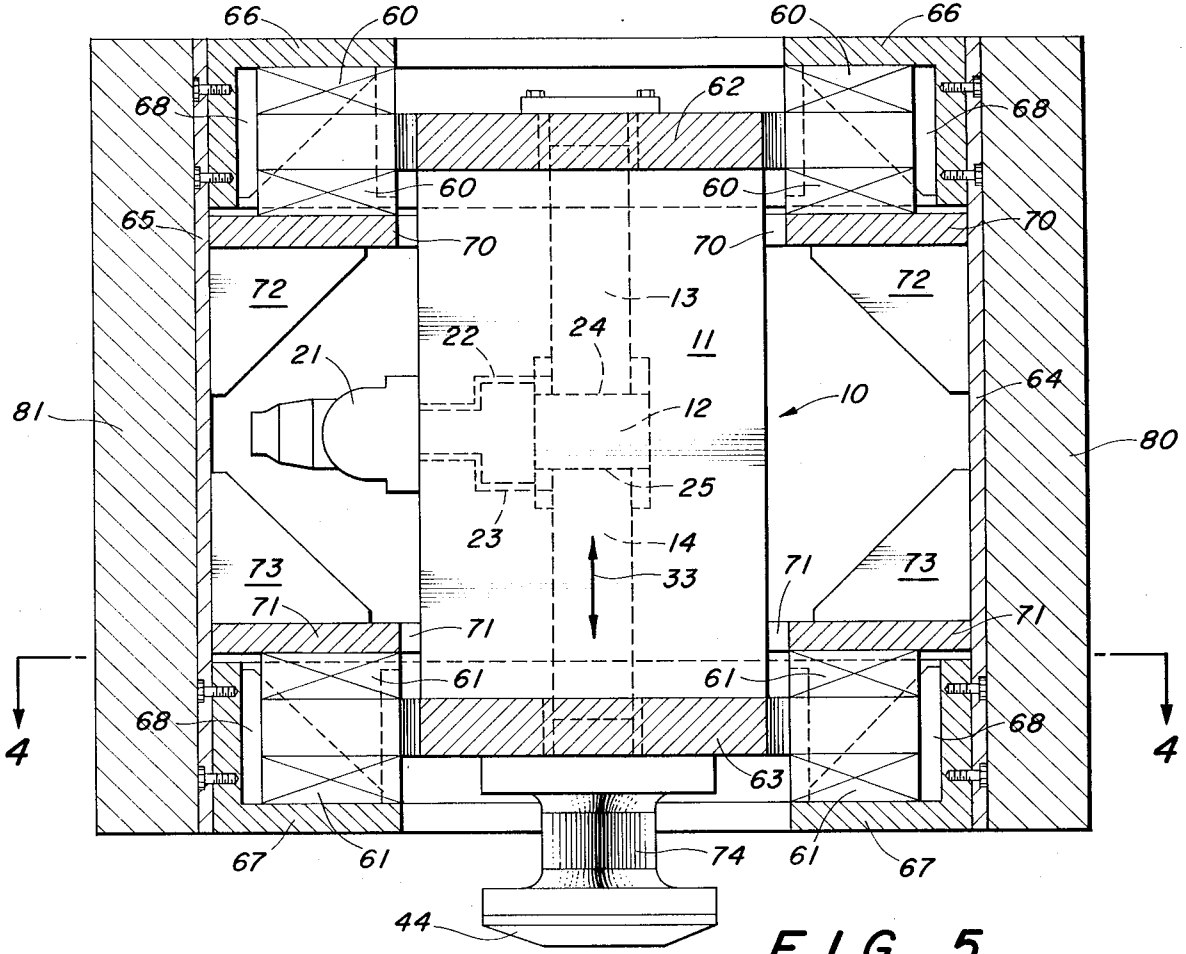
FIG. 5 is a side view of the apparatus illustrated in FIG. 4 taken through the lines 5—5 of FIG. 4.

Referring to FIGS. 4, 5 and 6, a modified apparatus is illustrated. In the device of FIGS. 4 through 6, mass 11 is restrained between upper elastomer springs 60 and lower elastomer springs 61 by upper plate 62 and lower plate 63 both being clamped between elastomer springs 60 and 61, respectively. Upper plate 62 is attached to the top of mass 11 while plate 63 is rigidly secured to the bottom of mass 11 in any usual manner, such as bolting plate 62 and 63 to mass 11. Hydraulic piston 12 with upper and lower surfaces 24 and 25, respectively, and upper and lower piston rods 13 and 14, respectively, along with ports 22 and 23 and control valve 21 are substantially identical to that described for the first embodiment.

The support structure for the embodiment illustrated in FIGS. 4 through 6 essentially comprises a pair of vertically disposed support members 64 and 65 which have attached thereto upper angular support members 66 and lower angular support members 67 which are formed in a box like structure and attached to vertical support members 64 and 65. Angular support members 66 is attached at the upper portion of vertical support members 64 and 65 and angular support members 67 is attached to the lower portion of vertical support members 64 and 65. Angular support members 66 and 67 are, in this embodiment shown, made out of angular steel and welded together to form the structure illustrated. A plurality of additional triangular supports 68 are spaced around upper angular support members 66 and lower angular support members 67 to provide additional strength. Elastomer springs 60 and 61 are supported in their lower and upper sides respectively by horizontally disposed plates 70 and 71, respectively. Triangular reinforcement braces 72 are attached between vertical support members 64 and horizontally disposed plates 70, in any usual manner and provide additional support for the horizontally disposed plates 70. A plurality of identical support members 73 are likewise attached between vertical support member 64 and plates 71.

The apparatus illustrated in FIGS. 4 through 6 likewise has an impact tool 44 attached to shank 74 to piston rod 14. Referring in particular to FIG. 4, additional vertical support plates 75 and 76 along with vertical support members 64 and 65 encase the vibrator unit and provide support for the additional triangular shaped reinforcement braces 72 and 73 which are attached to vertical support plates 75 and 76. These additional triangular support members are not illustrated in the drawings.

Attached to vertical support members 64 and 65 are masses 80 and 81 combined to form one of the two masses necessary for the operation of this invention along with the second mass which is formed by reaction mass 11. The function of these masses will be described in a later section of this specification.

Broadly, the device illustrated in FIGS. 4, 5 and 6 operates in substantially the same way as the device described in FIGS. 1 through 3. Hydraulic fluid enters control valve 21 and is ported through ports 22 and 23 to upper or lower surfaces 24 and 25, respectively, of piston 12. The alternate porting of the hydraulic fluid causes the piston which possesses substantial mass, to exert a force against reaction mass 11, against the frame and against mass 80. Hydraulic piston 12 and rods 13 and 14 are free to move inside reaction mass 11 in the direction of arrow 33. Such movement excites reaction mass 11 and elastomer springs 60 and 61 into resonance. Such force being transmitted through shaft 74 to tool 44.

Referring in particular to FIG. 6, the support frame comprises the hold down mechanism for supporting impact tool 44 against a surface to be broken. If the system illustrated in FIGS. 4 and 5 is to resonate at forty-five Hertz, then K1 should equal $5.4\times10^5$ pounds/inch. Mass 81 combined with 80 should equal 13,500/836 pounds-seconds /inch. C1 should be proportional to 0.05. K2 should equal 16,000 pounds/inch. Mass 11 should equal 2,700/386 pounds-seconds$^2$/inch. C2 should be proportional to 0.09 and the output displacement will result in a one inch peak to peak movement illustrated by arrow 33, will cause energy to be generated on a surface to be broken, for example, of 70,000 pound-inches. To obtain the above results, mass 11 (see FIGS. 4 and 5) is elastically secured between upper elastomer springs 60 which are mounted above and below plate 62. As can be seen from FIG. 4, at least eight elastomer springs 60 are mounted above plate 62 and an additional eight elastomer springs are mounted below plate 62. In addition to elastomer spring 60, a second plate 63 is attached between elastomer spring 61, above and below plate 63, substantially identical to that as described for plate 62 and elastomer spring 60. Thus, reaction mass 11 is elastically secured between elastomer springs 60 and 61.

PREFERRED EMBODIMENT

Figure 7:
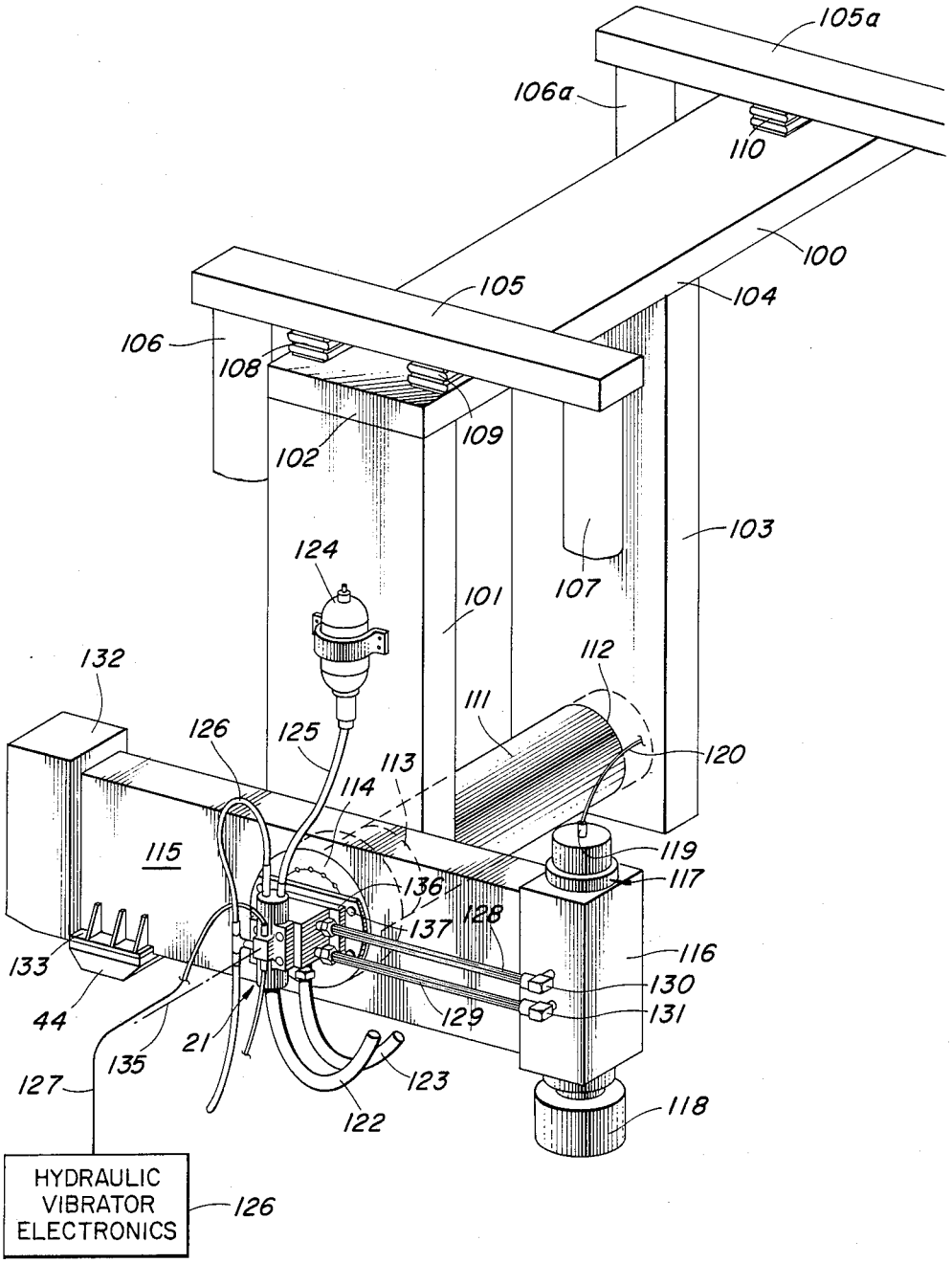
FIG. 7 is an isometric view of the road or hard surface breaking mechanism, particularly illustrating the hydraulic vibration apparatus.

Referring to FIGS. 8 through 15, the preferred embodiment is illustrated. Referring specifically to FIG. 7, an "F" shaped support structure essentially comprises a horizontally disposed rectangularly shaped steel member 100, having a first vertical leg 101 attached at end 102 of horizontal member 100 and a second spaced vertical leg 103 attached at 104 which is spaced from vertical support member 101. A portion of the lift apparatus is illustrated and essentially comprises a horizontal connecting structure 105 which is connected to its extremities to guide rods 106 and 107, respectively. A second lift apparatus, comprising a horizontal member **105*a*, likewise is connected at its extremities to guide rods 106*a* and a second guide rod, not illustrated. Horizontal member 100 is decoupled from horizontal connecting structure 105, but supported thereby, by means of isolation pads 108 and 109 above vertically disposed member 101, and isolation and 110 centrally located under horizontal connecting structure 105*a*. The lift cylinder has not been illustrated for purposes of simplifying the FIGURE. A torsional spring 111 is rigidly attached through an opening 112 in the lower portion of vertical support member 103. Torsional spring 111 passes through an opening 113 in the lower portion of vertical support member 101. Torsional spring 111 is free to rotate through opening 113 and 113 contains a bearing to permit ease of movement of torsional spring 111 in opening 113**.

Attached to an end 114 is an oscillating member 115. Torsional spring 111 is attached to oscillating member 115 in a manner to be described in a later portion of the specifications. On one end of oscillating member 115 is secured a mass 116 which includes a hydraulic vibrator 117 mounted internally in mass 116. Hydraulic vibrator 117 is similar to those discussed in FIGS. 1 through 7. Attached at one end of hydraulic vibrator 117 is a mass 118 and at the other end is a control LVDT 119. LVDT 119 has an output wire 120 which is connected with the electronic control system driving vibrator 117. The hydraulics to vibrator 117 is principally controlled by a servo valve referred to by arrow 21 which has connected thereto hydraulic input hoses 122 and 123 which function as input and output lines to servo control valve 21. A hydraulic accumulator 124 is attached through a hose 125 to servo valve 21 for providing hydraulic fluid under instantaneous high demand needs. An electronics unit 126 is coupled to servo control valve 21 and connected through conductors 127 to the electronic control system used for controlling the flow of hydraulic fluid from servo control valve 21 to pipes 128 and 129. Pipes 128 and 129 are coupled into hydraulic vibrator 117 through connections 130 and 131.

On the opposite end of oscillating member 115 is a second mass 132 and a tool holder 133 with impact tool 44 attached thereto. Servo valve 21 is mounted over the axis of rotation 135 of torsional spring 111 in order to substantially reduce the forces on servo control valve 21. Servo control valve 21 is mounted to torsional spring 111 in any usual manner such as a mounting plate 136 and bolts 137.

While horizontal support member 100 functions to support torsional spring 111, it also functions as a torsional reaction mass. Vertical support member 101 and 103 likewise support torsional spring 111, but vertical support 101 also functions as a vertical reaction mass, while 103 functions with horizontal support member 100 as a torsional reaction mass.

No braces have been shown coupling vertical support member 101 and 103 to horizontal support member 100. It is obvious that additional braces can be utilized to make vertical support members 101 and 103 structurally secure to horizontal support member 100 so that the triangular braces between 101 and 103 coupled to horizontal support member 100 will prevent undulations of horizontal support member 100 and vertical support members 101 and 103 during operation of torsional spring 111.

Figure 8:
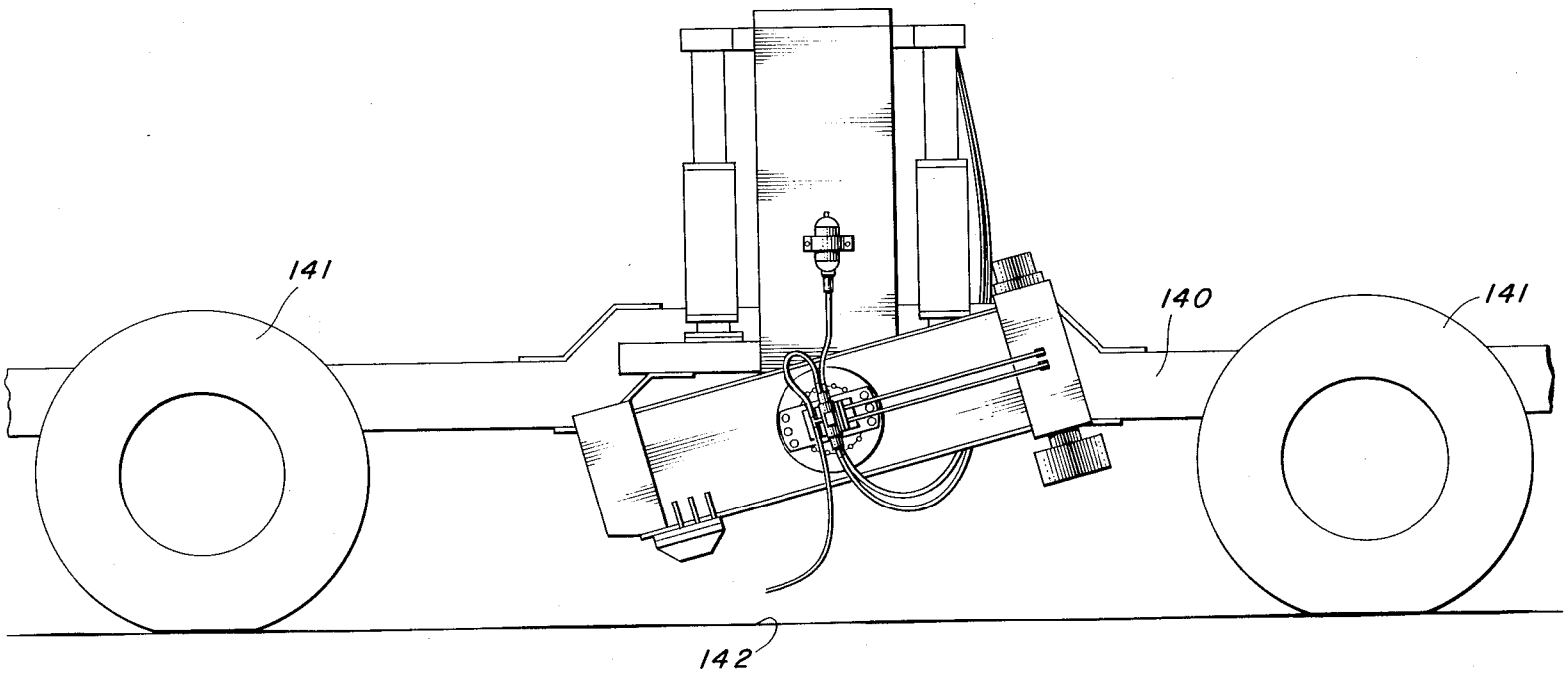
FIG. 8 is a side view of the preferred embodiment of this invention.

Referring to FIG. 8, it can be illustrated that the entire apparatus of FIG. 7 can be supported on a transportable frame 140, said frame being supported by wheels 141 in a manner to support frame 140 in substantial parallel position above a road surface 142.

Figure 11:
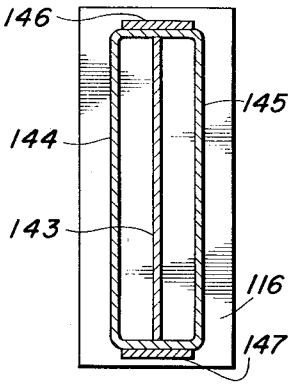
FIG. 11 is a cross-sectional view of the oscillating member taken through the lines 11—11 of FIG. 9.
Figure 10:
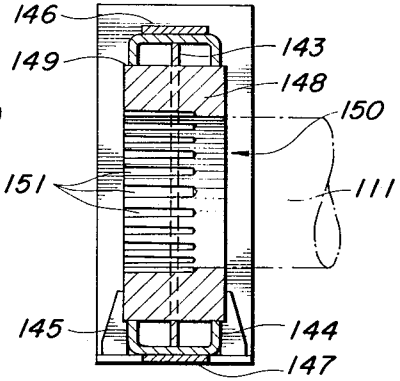
FIG. 10 is a cross-sectional view of the mounting hub illustrated in FIG. 9 taken through the lines 10—10.
Figure 9:
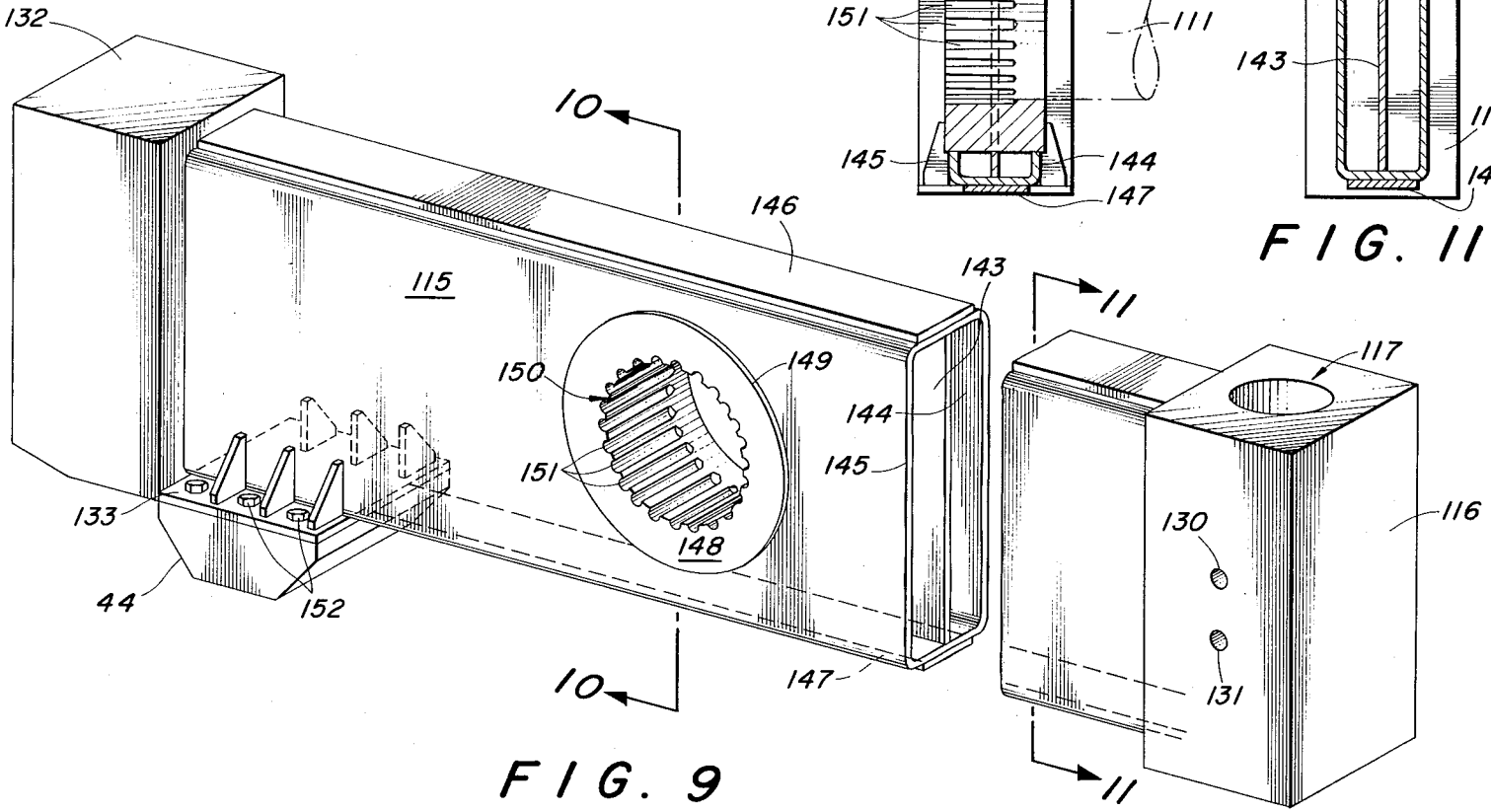
FIG. 9 is an isometric view of the oscillating member illustrated in FIG. 8 showing the construction of the oscillating member.

Referring to FIGS. 9, 10 and 11, a detail of the oscillating member 115 is illustrated. Oscillating member 115 is essentially fabricated from a plurality of longitudinal plates essentially comprising a center plate 143 which extends the length of oscillating member 115 along with "U" shaped external plates 144 and 145 which are welded to center plate 143 in a manner to secure each of them to center plate 143. Additional plates 146 and 147 are welded on the top and bottom of oscillating member 115 to provide additional support to center plates 143, plates 144 and 145.

Referring to FIG. 10, a central hub 148 is welded through an opening 149 formed through center plate 143 and outside "U" shaped plates 144 and 145. Opening 150 provides access for torsional spring 111 which is locked to central hub 148 by a plurality of pins and mating tapered holes 151 of which are provided and will be subsequently described. Impact tool 44 is attached to plate 133 by any usual means such as bolts 152.

Figure 13:
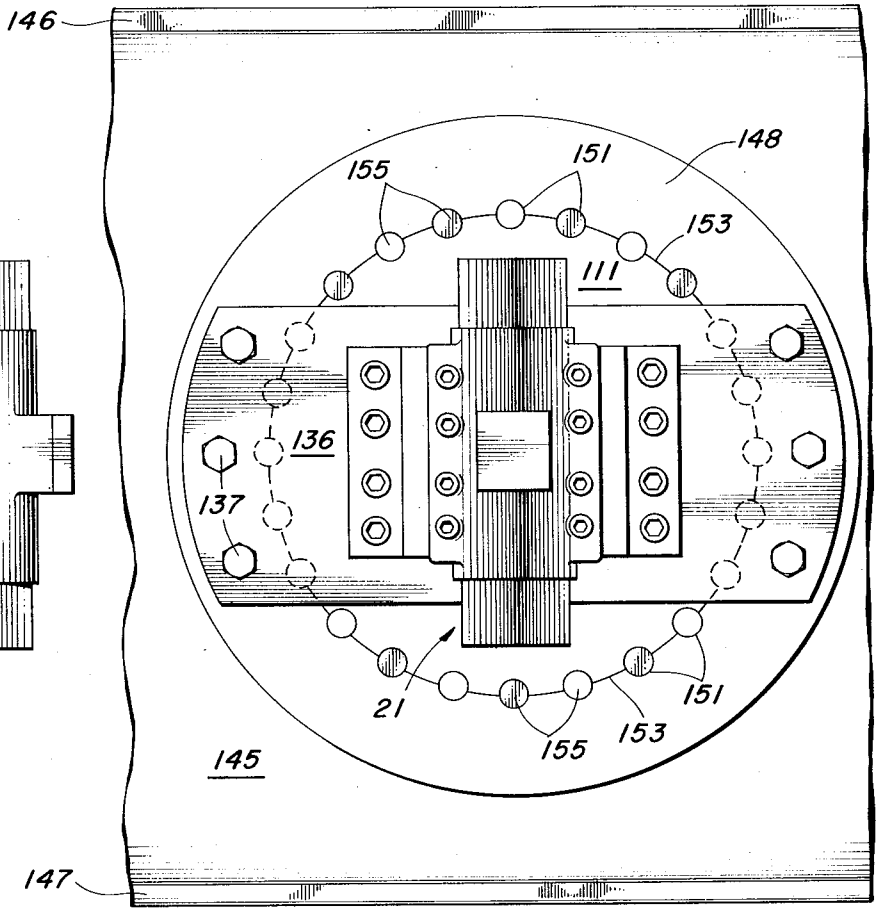
FIG. 13 is a side view of the mounting arrangement illustrated in FIG. 12.
Figure 12:
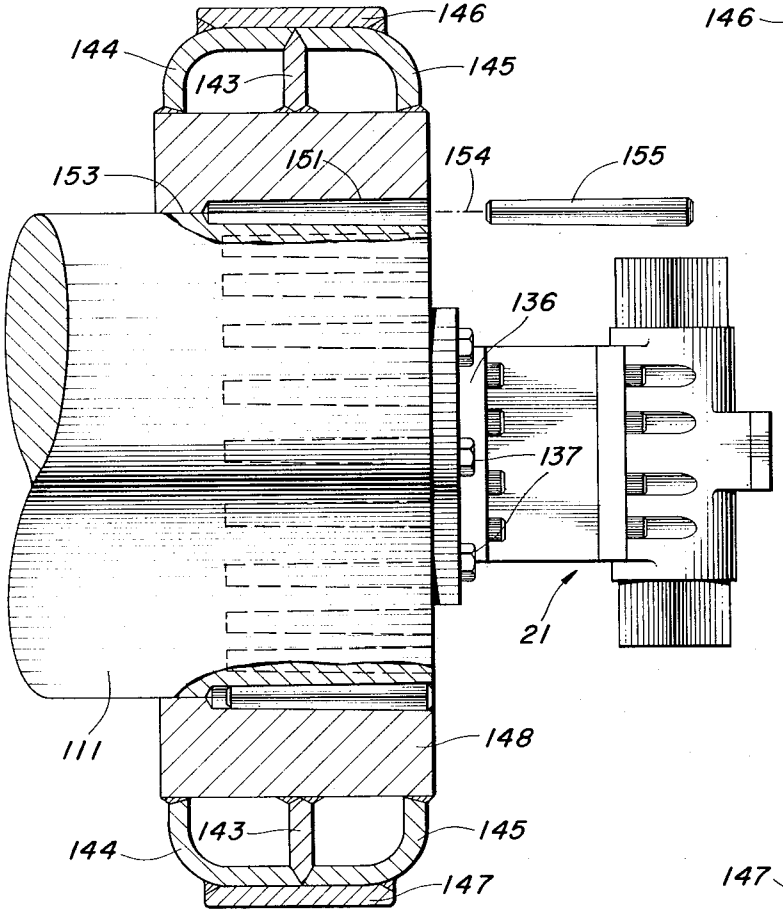
FIG. 12 is a cross-sectional view of the hub of the oscillating member illustrating the method of attachment of the torsional spring to the oscillating member.

Referring to FIGS. 12 and 13, the attachment of torsional spring 111 to central hub 148 is illustrated. When torsional spring 111 is assembled with hub 148, a plurality of tapered holes 151 are bored around the periphery 153 of torsional spring 111 and hub 148 in a manner so that holes 151 equally penetrate both torsional spring 111 and hub 148. These holes are tapered to fit a tapered pin 155, illustrated in FIG. 12. Pins 155 are forced in the direction of line 154 into tapered holes 151 with pin 155 being coated with some suitable liquid locking material. The material is basically a liquid which will harden over a period of time securely locking tapered pin 155 into tapered hole 151. Servo control valve 21, as previously discussed, is then attached by means of plate 136 and bolts 137 to torsional spring 111.

Figure 14:
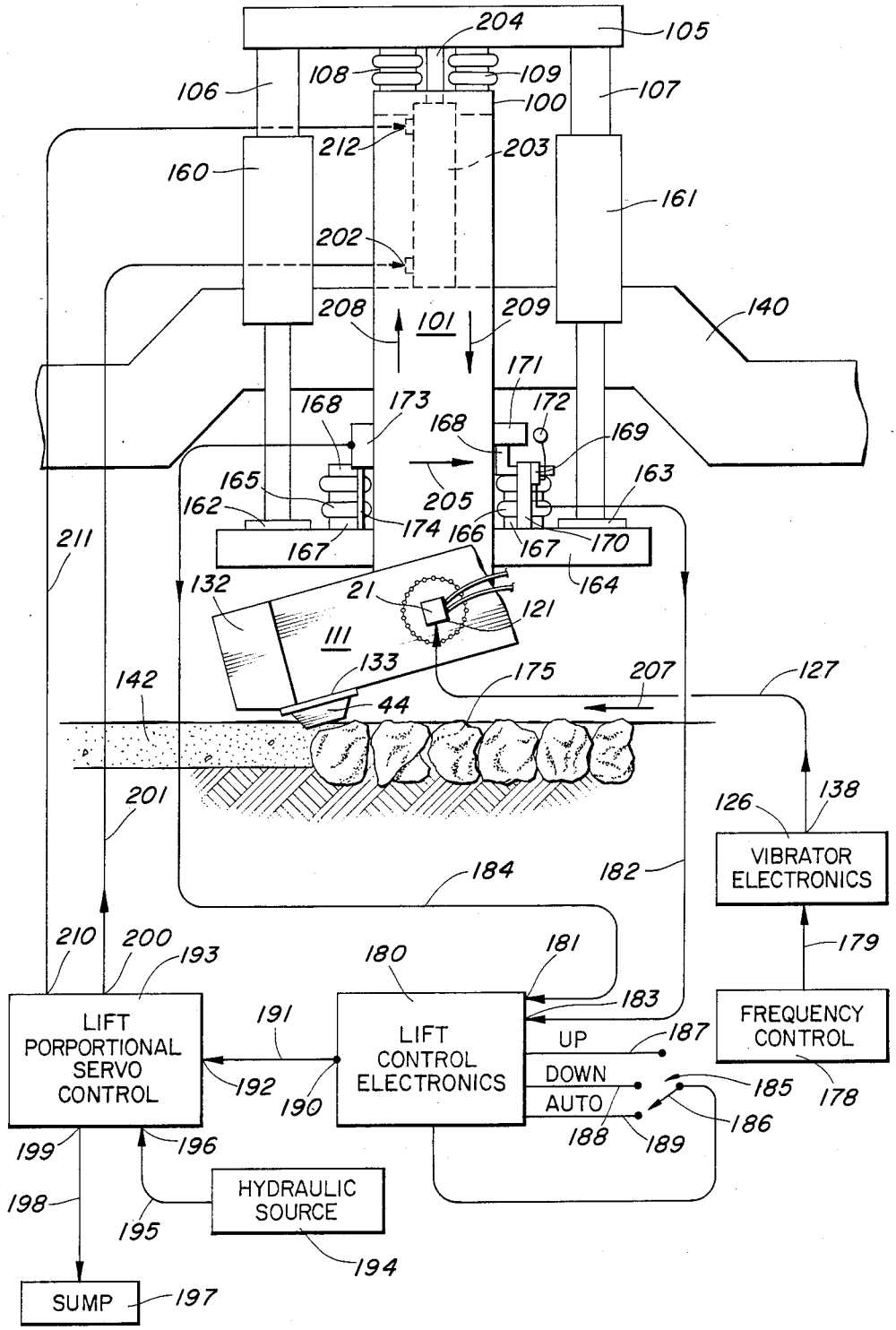
FIG. 14 is a side view of the road crushing equipment including block diagram of the electronic control system; and, FIG. 15 is a basic illustration of the operation of the apparatus of FIGS. 7 through 13 and also illustrates an alternate mounting for the oscillating member.

Referring to FIG. 14, the controls necessary to operate the apparatus illustrated in FIGS. 7 through 13 is illustrated. Guide rods 106 and 107 pass through guide rod bearing 160 and 161 in a manner to vertically support guide rods 106 and 107 and additionally permit free vertical movement of guide rods 106 and 107. The lower end of guide rods 106 and 107 is attached at a plate 162 and 163 to a horizontal support member 164. Attached between horizontal support member 164 and vertical support member 101 is a pair of isolation devises 165 and 166. Both isolation devises are attached through an "L" shaped bracket 167 to horizontal support member 164 and a second "L" shaped bracket 168 to vertical support member 101. A torque operated micro switch 169 is attached through a bracket 170 to horizontal support member 164. An actuating arm 171 is attached to vertical support member 101 and mounted in a manner to strike a switch arm 172. An LVDT 173 is attached to vertical support member 101 and has an arm 174 slidably touching horizontal support member 164. In the drawing illustrated, impact tool 44 is shown impacting road surface 142 with broken rubble 175 representing previously broken portions of road surface 142.

In order to properly control the lift system during the impact process, a lift control electronics 180 has an input 181 coupled through a wire 182 to torsionally controlled switch 169. A second input 183 is coupled through a wire 184 to LVDT 173. Lift control electronics 180 has a three positioned switch generally referred to by arrow 185. Switch 185 will control the lift by switch arm 186 which has selected positions 187 for moving the lift apparatus to an "up" position, 188 for "down" control of lift control electronics 180 and 189 for "automatic" control of lift control electronics 180. Output 190 of lift control electronic 180 is coupled through a wire 191 to an input 192 of lift proportional hydraulic servo control system 193. Servo control system 193 has a hydraulic source 194 coupled through a pipe 195 to input 196 of lift proportional hydraulic servo control system 193. A sump 197 is likewise coupled through a pipe 198 to output 199 of hydraulic servo control system 193. Output 200 and 210 of lift servo control system 193 is coupled through hydraulic pipe means 201 and 211 to inputs 202 and 212 of a lift cylinder 203 which is coupled to lift output shaft 204 which in turn is coupled to horizontal member 105. Vibrator electronics 126, as previously discussed in FIG. 7, may also have a variable frequency control input 178 coupled through 179 to vibrator electronics 126.

OPERATION

The operation of the apparatus illustrated in FIGS. 8 through 14 is best described by reference to FIGS. 14 and 15 where the mechanical, electrical and hydraulic aspects of the apparatus are described.

Figure 15:
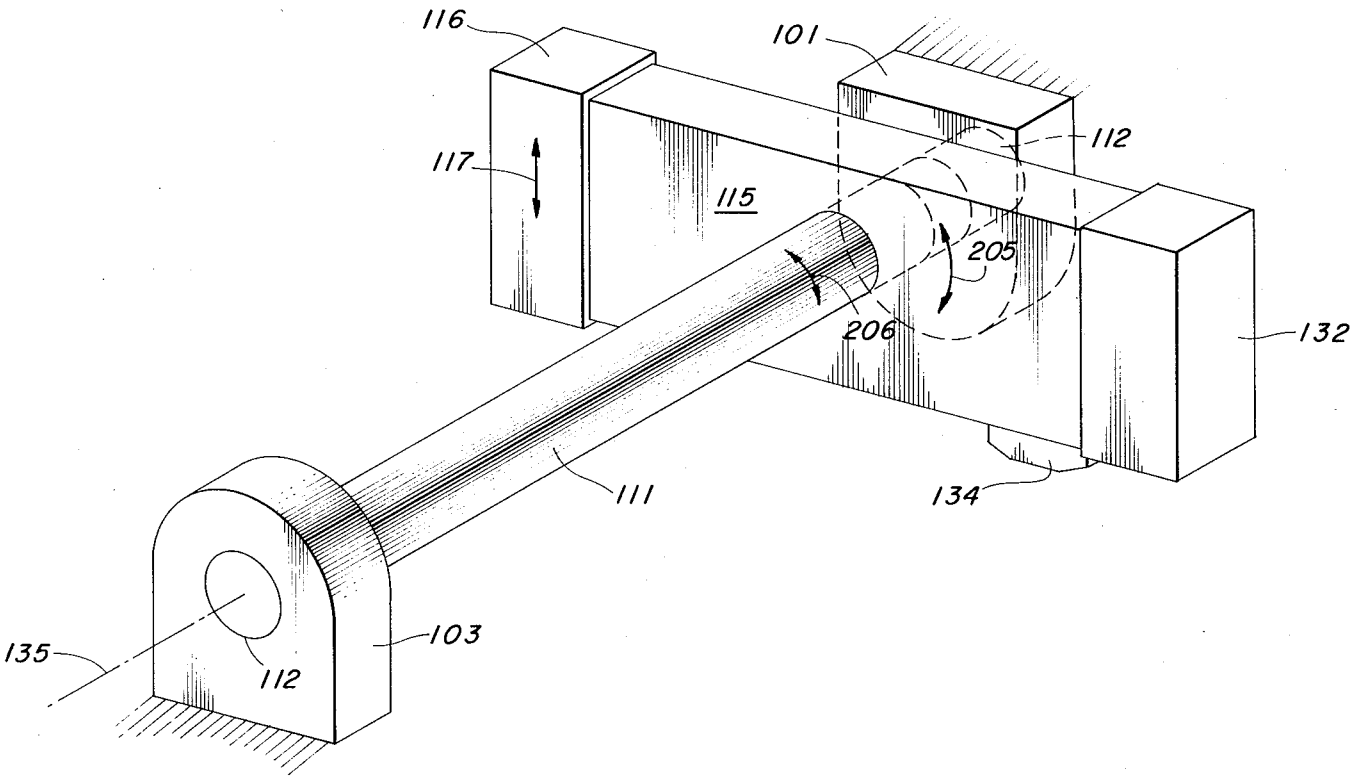

During the operation of the apparatus illustrated in FIG. 15, torsional spring 111 is rigidly anchored in opening 112 in a manner substantially identical to that described for attaching torsional spring 111 to hub 148 in FIG. 12, in that a plurality of pins 155 are inserted into a plurality of mating tapered holes 151 and locked using some form of locking cement so that pins 155 will not work loose during operation. In may be preferable to cover pins 155 with a plate (not illustrated) to insure that they do not work loose during the operation of the road breaking apparatus.

Mass 116 with its counter balancing mass 132 is operated by vibrating hydraulic vibrator 117 in a manner described in FIG. 1. As hydraulic vibrator 117 is operated, mass 118 (see FIG. 7) tends to remain stationary, causing an oscillation movement of mass 116 with a corresponding rotation of oscillating member 115 about axis 135 in the direction of arrow 205 (FIG. 5) and corresponding oscillation of torsional spring 111 in a manner illustrated by arrow 206. Proper selection of frequency, either as frequency control 178 or internal frequency control in electronics 126 (see FIG. 14), torsional spring 111, oscillating member 115, masses 116, 118 and 132 and impact tool 44 will reach resonance, causes a greatly increased force output to impact tool 44.

Referring to FIG. 14, vibrator electronics 136 generates an output at 138 through wire 127 to servo control valve 21. Normally frequency control 178 can be permanently set so that the resonance will be provided without additional adjustment of frequency control 179. However, such is obviously within the scope of the invention that a frequency control can be set or adjusted and set for optimum resonance of oscillating member 115.

Under transporting conditions, as illustrated in FIG. 8, the lift apparatus is operated so that switch 185 is in "up" position 187. Under these conditions, hydraulic pressure is applied to cylinder 203 (FIG. 14) so that shaft 204 is extended causing horizontal member 105 to move upwardly thus, lifting horizontal member 164 which is attached through isolation means 165 and 166 to vertical support member 101, thus, lifting vertical member 101 upwardly so that impact tool 44 will not strike the pavement during transportation. The road breaking apparatus as illustrated in FIG. 8, is being transported from one location to another. When it is desired to break a surface, however, or put the tool into operation, then lifting apparatus switch 185 is switched from position 187 to position 188 causing the hydraulic cylinder 203 to drain the hydraulic fluid out of the lower portion of the cylinder and inject hydraulic fluid under pressure into the upper portion of the cylinder. Such operation is well known in the art of hydraulic apparatus and will not be further discussed in this application.

Once impact tool 44 strikes road surface 142, then pressure is continually applied to upper portion of cylinder 203. As this pressure is applied, isolation devices 165 and 166 will begin to collapse under pressure. As they collapse, LVDT 173 through its arm 174 will begin to reduce the electrical signal to proporational valve 193 until the desired force being applied by lift cylinder 203 through rod 204 against lower horizontal member support member 164 is reached. When a predetermined amount of tool load is reached, such isolator deflection is communicated from LVDT 173 by wire 184 to input 183 of lift control electronics 180. Generally to use the apparatus, switch 186 is moved to position 189 which is the "auto" position. In this position, once a predetermined amount of deflection is detected by LVDT 173, lift control electronics 180 will generate an output at 190 through wire 191 to lift proportional hydraulic servo control apparatus 193. Such electrical signal will cause lift proportional servo control apparatus 193 to reduce or stop the pressure being applied to the upper portion of cylinder 203. LVDT 173 will then maintain at all times a predetermined amount of load (such as 10,000 pounds) by impact tool 44 against road surface 142. Since vertical support members 101, 103 and horizontal support member 100 are all isolatablity mounted through isolation means 165, 166, 108, 109 and 110 to the lift apparatus, any force against impact tool 44 in the direction of arrow 207 will cause a torque which will be transmitted to actuating arm 171 which will, in turn, impact switch arm 172. Once switch arm 172 is rotated to the extent that switch 164 is operated, a signal will be transmitted down wire 182 to input 181 of lift control electronics 180. Such a signal will cause lift control electronics 180 to communicate a lift command through wire 191 to proportional servo control circuit 193 causing a decrease in pressure in the upper portion of cylinder 203 and an increase in pressure in the lower portion of cylinder 203. Vertical support member 101 will be lifted in the direction illustrated by arrow 208. Once the torque, as illustrated by arrow 208 has been removed, then switch actuating arm 171 will disengage from switch arm 172 causing a loss of signal through wire 182 to input 181 of lift control electronics 180. When the above happens, the system will resort to the original control mode, that is, pressure will again be applied to the upper portion of lift cylinder 203 and reduced in the lower portion of cylinder 203, causing the lift mechanism to move downwardly as illustrated by arrow 209 until the predetermined tool load is again achieved. Hydraulic source 194 provides whatever hydraulic fluid is necessary to operate lift proportional servo control valve 193. Sump 197 through its outlet pipe 198 is provided for disposing of fluid as it passes through control valve 193, and to provide a reservoir for hydraulic fluid for hydraulic source 194.

The operation of a proportional servo control and its associated hydraulics is well known in the art and will not be discussed in detail in this application.

As the vehicle moves in direction of arrow 209, the lift control electronics then will continuously monitor both the torque against vertical support arm 101 and the load being applied against impact tool 44 and will continuously maintain a predetermined load by impact tool 44 against pavement 142 as it is broken into rubble 175. It is obvious that as the concrete breaks, the constant force will cause a dropping in the direction of arrow 209 by lift system cylinder 203. Thus, as it drops, it may become "hung-up" causing the previously discussed torque in the direction of arrow 207. Since the torque could cause damage to LVDT 173 and isolation mounts 165, 166, 108, 109 and 110, the torque must be limited by a predetermined amount.

CONCLUSIONS

Several embodiments of this invention have been disclosed. Each ebodiment encompasses a hydraulic vibrator mounted in a manner to cause a mass/spring system to arrive at a resonant condition. The resonant condition causes a magnification of mass displacement, and consequently, a large increase in available energy from the system. In the preferred embodiment, a single impact tool has been illustrated mounted on a torsional spring. It is obvious, that two or more impacting apparatus can be mounted on a single vehicle and still be well within the scope of the art as described in this invention and the invention is not limited to a single impacting apparatus mounted on a transportable vehicle. Furthermore, it is obvious that other devices can be coupled to the mounting tool location 133 and still be within the scope of this invention. Such additional tools, for example, may be used to "saw" instead of "break" the surface.

It is obvious, of course, that other modifications can be used and still be well within the spirit and scope of this invention as described in the specification and appended claims.

What I claim is:

1. Apparatus for breaking a hard surface comprising:

(a) a hydraulic force generating means having a hydraulic cylinder means, a hydraulic piston means slidably mounted inside said hydraulic cylinder means, a first mass means attached to said hydraulic piston means, second mass means coupled to hydraulic cylinder means; hydraulic control means having an electrical input, and an hydraulic input and a hydraulic output coupled to said hydraulic cylinder means in a manner to move said hydraulic piston means reciprocally in said hydraulic cylinder means;

(b) means for attaching said hydraulic force generating means to an impacting tool; and, (c) electrical means coupled to said electrical input in a manner to control said reciprocation at substantially the resonant frequency of said hydraulic force generating means;

whereby when said hydraulic force generating means is in resonance with said impacting tool in partial contact with said hard surface, said impacting tool will crush and break said hard surface.

2. Apparatus in accordance with claim 1 wherein said means for attaching said hydraulic force generating means to said impacting tool comprises a piston rod means extending from said hydraulic piston means; and means for attaching said impacting tool to said piston rod means.

3. Apparatus as described in claim 1 wherein said means for attaching said hydraulic force generating means to said impacting tool comprises a torsional spring means having first and second ends, means for rigidly anchoring said first end in a manner to prevent reciprocating movement of said first end; oscillation member means having first and second ends and a mounting means disposed between said first and second ends; means for attaching said hydraulic force generating means to said first end; means of attaching said impacting tool near said second end and means for attaching said second end of said torsional spring means to said mounting means such that such impacting tool can be positioned in impact proximity to said hard surface.

4. A hard surface breaking apparatus comprising:
(a) a hydraulic power generating means having a cylinder means, a piston said piston slidably positioned inside said cylinder means having an upper surface and a lower surface a first and second piston rod means attached to and extending from said upper and lower surfaces respectively, hydraulic actuation means coupled to said cylinder means in a manner to reciprocate said piston at a predetermined frequency;
(b) impact tool means attached to said second piston rod means;
(c) vertical support means; and,
(d) isolation means coupled between said vertical support means and said hydraulic power generating means in a manner to selectively position and isolate forces generated by said impact tool.

5. Apparatus as described in claim 4 wherein said predetermined reciprocation rate is at the resonant frequency of said hydraulic power generating means coupled to said impact tool.

6. Apparatus as described in claim 4 wherein said hydraulic power generating means includes a mass attached to said first piston rod means.

7. Apparatus as described in claim 5 wherein said hydraulic power generating means includes a mass attached to said first piston rod means.

8. Apparatus as described in claim 4 wherein said vertical support means includes a plurality of spaced pads attached around said vertical support means and slidably engaging said cylinder means.

9. Apparatus as described in claim 4 wherein said vertical support means includes a lift apparatus having a first position for positioning said impact tool means a substantial distance above said hard surface for transporting said impact tool means to a new location and a second position for positioning said impact tool means in proximity to said hard surface for breaking said hard surface.

10. Apparatus as described in claim 5 wherein said vertical support means includes a lift apparatus having a first position of positioning said impact tool means a substantial distance above said hard surface for transporting said impact tool means to a new location and a second position for positioning said impact tool means in proximity to said hard surface for breaking said surface.

11. Apparatus as described in claim 6 wherein said vertical support means includes a lift apparatus having a first position for positioning said impact tool means a substantial distance above said hard surface for transporting said impact tool means to a new location and a second position for positioning said impact tool means in proximity to said hard surface for breaking said surface.

12. Apparatus as described in claim 4 wherein said vertical support means includes a first and second yieldable support means attached to said vertical support means above and below said cylinder means respectively, cylinder extension means attached to said cylinder means and said yieldable support means whereby said cylinder means is positioned between said first and second yieldable support means thereby containing said cylinder means during reciprocation of said cylinder means.

13. Apparatus for breaking a hard surface comprising:
(a) a support means;
(b) torsional spring means having first and second end means and an axis;
(c) rigid attachment means for securing said first end means of said torsional spring means to said support means;
(d) rotational attachment means spaced from said first end means for rotationally supporting said torsional spring means to said support means;
(e) oscillating force generating means coupled to said torsional spring means for generating an "arc-like" oscillation of said torsional spring means about its axis;
(f) impact tool means;
(g) means for rigidly securing said impact tool means to said torsional spring means wherein said impact tool means is arcuately oscillated upon arcuate oscillation of said torsional spring means; and,
(h) means for positioning said impact tool means in impact proximity to said hard surface.

14. Apparatus as described in claim 13 wherein said means for securing said impact tool means comprises an oscillating member rigidly attached between said impact tool and said torsional spring means.

15. Apparatus as described in claim 13 comprising an oscillating member; and, wherein said oscillating force generating means is attached to said torsional spring means by said oscillating member.

16. Apparatus as described in claim 13 wherein said means for rigidly securing comprises an oscillating member attached to said torsional spring means between said rigid attachment means and said rotational attachment means of said torsional spring means.

17. Apparatus as described in claim 13 wherein said means for rigidly securing comprises an oscillating member attached to said torsional spring means between said rotational attachment means and said second end means.

18. Apparatus as described in claim 13 wherein said means for rigidly securing comprises an oscillating member having a first and second end, said impact tool means being attached at said first end and said oscillating force generating means being attached at said second end.

19. Apparatus as described in claim 18 wherein said oscillating member is attached to said torsional spring means between said rigid attachment and said rotational support for said torsional spring means.

20. Apparatus as described in claim 19 wherein said oscillating member is attached to said torsional spring between said rigid attachment means and said attachment means for said torsional spring means.

21. Apparatus as described in claim 18 wherein said oscillating member is attached to said torsional spring means at said second end.

22. Apparatus for breaking a hard surface comprising:
(a) a vertical support means;
(b) torsional spring means having first and second ends;
(c) means for rigidly attaching said first end of said torsional spring means horizontally to said vertical support means;
(d) means, spaced from said first end for rotatably mounting said torsional spring means to said vertical support means;
(e) an oscillating member means having first and second ends;
(f) impact tool means;
(g) oscillating force generating means;

(h) means for securing said impact tool means at said first end of said oscillating member means;

(i) means for mounting said oscillating force generating means at said second end of said oscillating member means;

(j) means for securing said oscillating member intermediate said first and second ends thereof to said torsional spring means; and, (k) means attached to said vertical support means for positioning said impact tool means in impact proximity to said hard surface whereby when said oscillating force generating means is oscillated, an arcuate movement will be created about said oscillating member thereby causing a like arcuate movement of said impact tool means causing oscillating impart forces against said hard surface.

23. Apparatus as described in claim 22 including lifting means isolatably attached to said vertical support means to provide a first position to space said impact tool means a substantial distance above said hard surface for transporting said impact tool means, and a second piston to position said impart tool means in impact proximity with said hard surface.

24. Apparatus as described in claim 22 wherein said oscillating force generating means comprises a hydraulic cylinder attached to said second end of said oscillating member, piston means slidably mounted inside said cylinder, hydraulic piston actuating means communicating through said cylinder on each side of said piston in a manner to reciprocate said piston at a predetermined frequency, and a mass means coupled to said piston means.

25. Apparatus for oscillating a tool means at resonance comprising:

(a) a vertical support means;

(b) torsional spring means having first and second ends;

(c) means for rigidly attaching said first end of said torsional spring means horizontally to said vertical support means;

(d) means, spaced from said first end for rotatably mounting said torsional spring means to said vertical support means;

(e) an oscillating member means having first and second ends;

(f) oscillating force generating means;

(g) means for securing said tool means at said first end of said oscillating member means;

(h) means for mounting said oscillating force generating means at said second end of said oscillating member means;

(i) means for securing said oscillating member intermediate said first and second ends thereof to said torsional spring means; and, (j) means attached to said vertical support means for positioning said tool means.

whereby when said oscillating force generating means is oscillated, an arcuate movement will be created about said oscillating member thereby causing a like arcuate movement of said tool means causing oscillating forces to be generated in said tool means.

26. Apparatus as described in claim 25 including lifting means isolatably attached to said vertical support means to provide a first position to space said tool means a substantial distance above a surface for transporting said tool means, and a second piston to position said tool means in proximity with said surface.

27. Apparatus as described in claim 25 wherein said oscillating force generating means comprises a hydraulic cylinder attached to said second end of said oscillating member, piston means slidably mounted inside said cylinder, hydraulic piston actuating means communicating through said cylinder on each side of said piston in a manner to reciprocate said piston at a predetermined frequency, and a mass means coupled to said piston means.

* * * * *